United States Patent [19]

Koellner

[11] 4,129,218

[45] Dec. 12, 1978

[54] MULTIPLE HANGER

[76] Inventor: Guido Koellner, Leyher Strasse 9, 8500 Nuremberg, Fed. Rep. of Germany

[21] Appl. No.: 844,862

[22] Filed: Oct. 25, 1977

[30] Foreign Application Priority Data

Nov. 10, 1976 [DE] Fed. Rep. of Germany ..... 2651261

[51] Int. Cl.[2] ..... A47F 5/08

[52] U.S. Cl. ..... 211/116; 211/119; 223/88

[58] Field of Search ..... 211/113-119, 211/105.1, 104, 105, 201, 202; 248/317, 318, 339, 340, 214, 215, 324, 341, 276, 277; 223/85, 87-94

[56] References Cited

U.S. PATENT DOCUMENTS

| | | | |
|---|---|---|---|
| 2,634,032 | 4/1953 | Bartlett | 223/88 |
| 3,373,878 | 3/1968 | Daitch | 211/119 |
| 3,528,590 | 9/1970 | Nathanson | 223/85 |

FOREIGN PATENT DOCUMENTS

| | | | |
|---|---|---|---|
| 959780 | 10/1949 | France | 223/88 |
| 84202 | 7/1954 | Norway | 211/113 |
| 923293 | 4/1963 | United Kingdom | 223/88 |

*Primary Examiner*—Roy D. Frazier
*Assistant Examiner*—Terrell P. Lewis
*Attorney, Agent, or Firm*—Frank J. Jordan

[57] ABSTRACT

A multiple hanger for garments such as blouses, shirts and the like, includes a plurality of generally parallel hanger elements on which the garments are hung. A connecting rod is pivotally connected to each of the hanger elements, and a guiding rod is pivotally connected to each of the hanger elements parallel to and spaced from the connecting rod to thereby provide a parallelogrammatic linkage such that the hangers are pivotal simultaneously in parallel array.

8 Claims, 2 Drawing Figures

MULTIPLE HANGER

BACKGROUND OF THE INVENTION

This invention relates to a multiple hanger and more particularly to a multiple hanger for garments such as blouses and shirts where a plurality of single hangers which are parallel to each other are pivotally hinged to a connecting rod.

A multiple hanger of this kind may be suspended in one suspension position so that the connecting rod is disposed horizontally, whereby the hangers are suspended adjacent to each other. However, it is also possible to suspend the multiple hanger unit at one end only so that the other hangers hang substantially vertically below each other due to the pivotal arrangement. The latter results in a particularly space-saving staggering arrangement which practically extends but little in the horizontal direction. Moreover, this arrangement is particularly suitable to pack blouses and shirts in their suspended position into trunks where they are simply and space-savingly stored. Despite this advantage they can be removed by one handling at the destination of the trip in order to be hung in a closet or the like.

Heretofore known arrangments of multiple hangers had the disadvantage that the pivotal hinging of the individual hangers on the connecting means did not lead to a common or simultaneous pivoting, even when the connecting means was formed by a continuous element and not, like in some other known embodiments, by separate hinged connections. Due to this lack of common or simultaneous pivoting, these known multiple hangers had a tendency to become twisted when the mode of suspension was changed from one to the other, thereby frequently resulting in sliding off of the suspended shirts or blouses. This is particularly disagreeable when such multiple hangers are used for the storing of blouses in apparel shops because, as is known from experience, customers prefer to remove blouses which interest them individually off the racks. That would, of course, result in the danger that simultaneously several blouses might slip off their hangers or even drop to the floor.

In order to overcome these disadvantages of these known prior art arrangements, an improved multiple hanger is provided, according to the present invention, by adding a guiding rod, parallel to a connecting rod, such that the hangers are pivotally connected to the guiding rod at a distance from their pivotal connection to the connecting rod.

The guiding rod, added on according to the present invention, connects the individual hangers to form a parallelogrammatic linkage which provides common or simultaneous pivoting of the hangers when the mode of suspension is changed. This parallelogrammatic linkage practically prevents the danger that one of the hangers might begin to move or turn when touched or handled so that suspended blouses or garments might become twisted or even fall to the floor.

Moreover, a hanger may now be easily taken out without the need to align the rest of the hangers, and also the change from a horizontal position to a vertical position and conversely is easily effected.

According to one embodiment of the present invention, a connecting rod and a guiding rod are made of flat strips to which are fastened flattened portions of the hanger hooks. Pivotal connection of the hanger hooks are provided by riveted connections. This arrangement provides for a particularly simple manufacture of the multiple hanger according to the present invention without requiring any additional means to prevent the hangers from being rotated or twisted around the axes of the hanger hooks.

Moreover it lies withint the framework of the present invention to elongate or extend the hanger hooks of the two end hangers of a multiple hanger, and to provide these two end hooks with suspension hooks. According to whether one only or both hooks are hung on a clothes rack, the hangers will hang parallel to each other or obliquely, almost vertical. The amount of departure from the vertical position or a negligible inclination of the individual hangers is determined by the width of and the distance between the connecting rod and guiding rod.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

SUMMARY OF THE INVENTION

A multiple hanger for garments such as blouses, shirts and the like comprises a plurality of generally parallel hanger elements on which the garments are hung, a connecting rod pivotally connected to each of the hanger elements, and a guiding rod pivotally connected to each of the hanger elements, the guiding rod being parallel to and spaced from the connecting rod.

DESCRIPTION OF THE PREFERRED EMBODIMENTS

Figure 1:
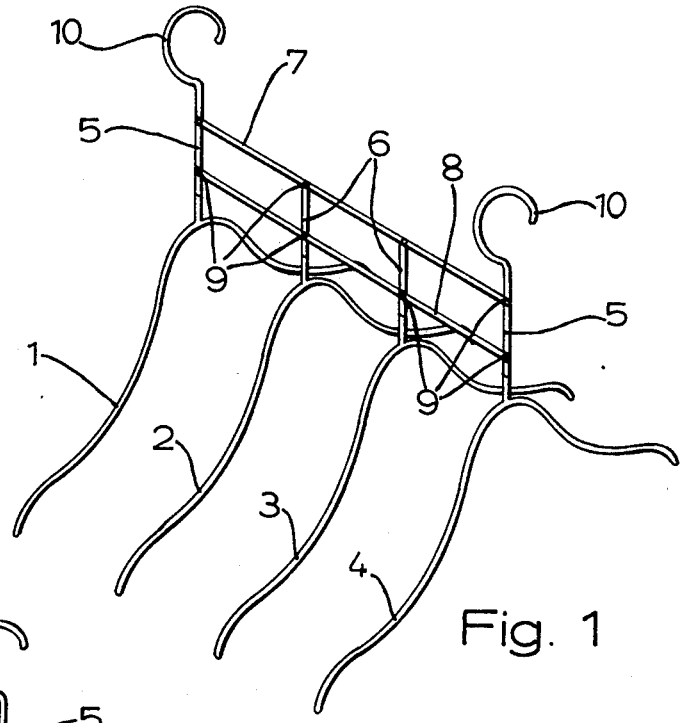
FIG. 1 is a perspective view of a multiple hanger according to the invention in a first suspension position.

In the illustrated embodiment, four individual hangers 1 to 4 each have flattened hanger suspension rods 5 or 6 which are spaced at a distance from each other and are pivotally mounted or hinged on a connecting rod 7 and a guiding rod 8. The pivotal connection may be effected by riveted connections 9 between the flat hanger suspension rods 5,6 and the rods 7 and 8 which are also fabricated out of flat strips. The hanger suspension rods 5 of the two end hangers 1 and 4 are elongated to extend above the connecting rod 7 and are each provided with a suspension hook 10. The connecting rod 7 and the guiding rod 8 form together with the hanger suspension rods 5 and 6 of the individual hangers 1 to 4 a parallelogrammatic linkages which forcibly guides the hangers when the rods 7 and 8 are moved against each other.

Figure 2:
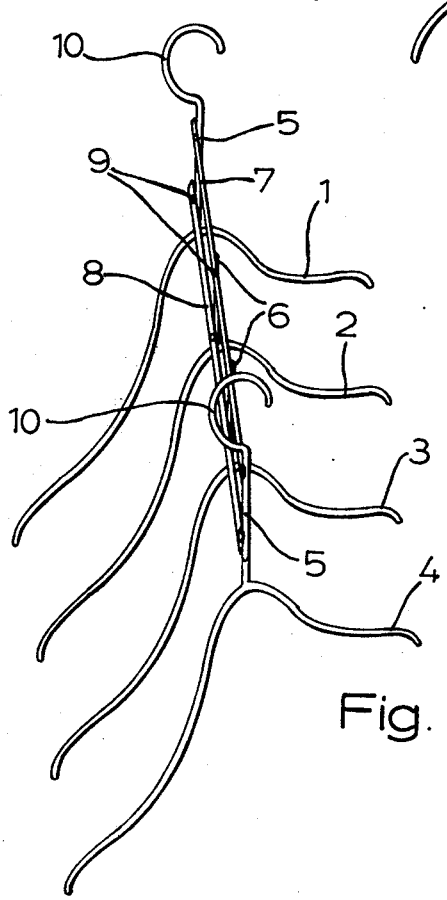
FIG. 2 is a perspective view of the multiple hanger of FIG. 1 in a second suspension position.

If the multiple hanger is suspended by only one of the suspension hooks 10 of the hanger 1 (FIG. 2) instead of by both hooks 10 to a rack as shown in FIG. 1, then the hooks 1 to 4 pivot in a position where they are substantially positioned vertically underneath each other as shown in FIG. 2. The pivotal connection of both parallel rods 7,8 with the rods 5,6 results in a uniform pivoting of all hangers 1 to 4 so that an opposite pivoting of individual hangers or the danger that they become entangled and that some of the hanging blouses or garments might slip to the floor is completely prevented.

The invention is not limited to the embodiment shown. Although four hangers are shown in the illustrated embodiment, any number of individual hangers may be combined to form a multiple hanger according to the present invention. It would also be possible to form the hangers in another manner so that they could also be used for the suspension of skirts instead of for the suspension of shirts and blouses alone. The hangers could be also used for the suspension of skirts alone.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed:

1. A multiple hanger for garments such as blouses, shirts and the like, comprising at least three generally parallel hanger elements on which said garments are hung, a connecting rod pivotally connected to each of said hanger elements, and a guiding rod pivotally connected to each of said hanger elements, said guiding rod being parallel to and spaced from said connecting rod, said pivotally connected guiding rod, connecting rod, and hanger elements forming a parallelogrammatic linkage such that all of said hanger elements pivot simultaneously in parallel array, whereby when in use the multiple hanger is pivotal to a first position wherein the connecting rod and guiding rod are horizontally disposed and the hanger elements are all disposed at the same elevation, and to a second position wherein the connecting rod and guiding rod are substantially vertically disposed and the hanger elements are disposed at different elevations substantially one above the other.

2. A multiple hanger according to claim 1 wherein said pivotally connected guiding rod, connecting rod, and hanger elements form a parallelogrammatic linkage such that all of said hanger elements pivot simultaneously in parallel array.

3. A multiple hanger according to claim 1 wherein the portions of the connecting rod and the portions of the guiding rod which are pivotally connected to the hanger elements are made of a flat material.

4. A multiple hanger according to claim 1 wherein said connecting rod and said guiding rod are made of flat strips of material.

5. A multiple hanger according to claim 1 wherein the portions of the hanger elements which are pivotally connected to said connecting rod and to said guiding rod are made of a flat material.

6. A multiple hanger according to claim 1 wherein said connecting rod and said guiding rod are pivotally connected to said hanger elements by rivets.

7. A multiple hanger for garments such as blouses, shirts and the like, comprising at least three identical hanger elements on which said garments are hung, said hanger elements being parallel to one another and being spaced from one another, said hanger elements having a transverse member on which the garments are disposed and a central vertical member extending upwardly from said transverse member, said transverse members being parallel to one another and being spaced from one another, a connecting rod pivotally connected to each of said central vertical members, and a guiding rod pivotally connected to each of said central vertical members, said guiding rod being parallel to and spaced from said connecting rod, said pivotally connected guiding rod, connecting rod, and central vertical members forming a parallelogrammatic linkage such that all of said hanger elements pivot simultaneously in parallel array, whereby when in use the multiple hanger is pivotal to a first position wherein the connecting rod and guiding rod are horizontally disposed and the hanger elements are all disposed at the same elevation, and to a second position wherein the connecting rod and guiding rod are substantially vertically disposed and the hanger elements are disposed at different elevations.

8. A multiple hanger for garments such as blouses, shirts and the like, comprising at least three identical hanger elements on which said garments are hung, said hanger elements being parallel to one another and being spaced from one another, said hanger elements having a transverse member on which the garments are disposed and a central vertical member extending upwardly from said transverse member, said transverse members being parallel to one another and being spaced from one another, a connecting rod pivotally connected to each of said central vertical members, a guiding rod pivotally connected to each of said central vertical members, said guiding rod being parallel to and spaced from said connecting rod, said pivotally connected guiding rod, connecting rod, and central vertical members forming a parallelogrammatic linkage such that all of said hanger elements pivot simultaneously in parallel array, said hanger elements comprising at least two end hanger elements having upwardly extending extensions forming continuations of the respective central vertical member, the upper ends of said extensions being provided with suspension hooks for suspending the multiple hanger, said connecting rod and said guiding rod have terminating end portions pivotally connected to said two end hanger elements, whereby when in use the multiple hanger is pivotal to a first position wherein the connecting rod and guiding rod are horizontally disposed and the hanger elements are all disposed at the same elevation, and to a second position wherein the connecting rod and guiding rod are substantially vertically disposed and the hanger elements are disposed at different elevations.

* * * * *